US005660972A

United States Patent [19]

Kiyama et al.

[11] Patent Number: 5,660,972

[45] Date of Patent: Aug. 26, 1997

[54] METHOD FOR PHOTOGRAPHIC DEVELOPMENT USING A FILTER TO INHIBIT OCCURRENCE OF SILVER SLUDGES

[75] Inventors: Hideto Kiyama; Tamotu Iwata; Yukinao Kawamata; Susumu Baba, all of Tokyo, Japan

[73] Assignee: Mitsubishi Paper Mills Limited, Tokyo, Japan

[21] Appl. No.: 404,148

[22] Filed: Mar. 14, 1995

[30] Foreign Application Priority Data

| | | | |
|---|---|---|---|
| Mar. 16, 1994 | [JP] | Japan | 6-045395 |
| Mar. 16, 1994 | [JP] | Japan | 6-045397 |
| Mar. 16, 1994 | [JP] | Japan | 6-045400 |

[51] Int. Cl.[6] ..... G03C 5/18; G03C 5/26

[52] U.S. Cl. ..... 430/399; 430/403; 430/416; 430/488

[58] Field of Search ..... 430/399, 403, 430/416, 488; 354/324

[56] References Cited

U.S. PATENT DOCUMENTS

| | | | |
|---|---|---|---|
| 1,925,557 | 9/1933 | Dundon | 430/488 |
| 3,173,789 | 3/1965 | King et al. | 96/61 |
| 3,318,701 | 5/1967 | Corben | 96/61 |
| 3,628,955 | 12/1971 | Haist et al. | 96/61 |
| 4,988,448 | 1/1991 | Woog | 430/399 |
| 5,210,009 | 5/1993 | McGuckin | 430/399 |
| 5,310,629 | 5/1994 | McGuckin et al. | 430/488 |

FOREIGN PATENT DOCUMENTS

| | | | |
|---|---|---|---|
| 484293 | 6/1992 | Canada | 430/416 |
| 0518627 | 12/1992 | European Pat. Off. | 430/488 |
| 52-36029 | 3/1977 | Japan . | |
| 55-95947 | 7/1980 | Japan . | |
| 56-72441 | 6/1981 | Japan . | |
| 60-258537 | 12/1985 | Japan . | |
| 64-50047 | 2/1989 | Japan . | |
| 3273235 | 12/1991 | Japan . | |
| 3273236 | 12/1991 | Japan . | |
| 4-190349 | 7/1992 | Japan | 430/488 |
| 940169 | 7/1961 | United Kingdom . | |
| 1144481 | 10/1966 | United Kingdom . | |

OTHER PUBLICATIONS

*Research Disclosure,* Sep. 1972, pp. 60–62, "Developing Agents", No. 10/42.

*Research Disclosure,* Oct. 1981, p. 383, "Ultrafiltration of Photographic Processing Fluids", No. 21021, Eggink et al.

Corben et al. "Very Rapid Monobath Processing", The Journal of Photographic Science, 1965, vol. 13, No. 5, pp. 233–239.

Haist et al. "Inhibition of Silvering in Thiosulfate Monobaths", Photographic Science and Engineering, 1976, vol. 20, No. 5, pp. 220–224.

*Primary Examiner*—Glenn A. Caldarola

*Assistant Examiner*—J. Pasterczyk

*Attorney, Agent, or Firm*—Cushman Darby & Cushman IP Group of Pillsbury Madison & Sutro LLP

[57] ABSTRACT

Disclosed is a method for developing silver halide photographic photosensitive materials with a developer containing a sulfite wherein said developer contains 20 mol % or more of potassium ion based on the total alkali metal ions, 0.04 mol/l or more of bromine ion or a compound represented by the following formula (I):

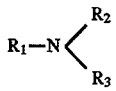

(I)

wherein $R_1$ represents a hydroxyalkyl group having 2–10 carbon atoms and $R_2$ and $R_3$ each represent a hydrogen atom, an alkyl group having 1–10 carbon atoms or a hydroxyalkyl group having 2–10 carbon atoms and the developer is filtered by a filter containing physical development nuclei before, during or after development of the photosensitive materials with the developer. The method is especially effective in processing using an automatic processor. According to the present method, formation of silver sludges is effectively inhibited and thus, stain of roll and belt of the processors can be prevented. According to the present method, formation of silver sludges is effectively inhibited and thus, stain of roll and belt of the processors can be prevented.

7 Claims, No Drawings

METHOD FOR PHOTOGRAPHIC DEVELOPMENT USING A FILTER TO INHIBIT OCCURRENCE OF SILVER SLUDGES

BACKGROUND OF THE INVENTION

The present invention relates to a method for development of silver halide photographic photosensitive materials and in particular, to a method for inhibition of occurrence of silver sludges in a developer.

It is well known that developers used for development of silver halide photographic photosensitive materials generally contain a sulfite for increase of storage stability of the developers. Furthermore, there may be used developers such as developers for silver salt diffusion transfer process and combined developing and fixing solutions which contain compounds having a strong dissolving action for silver halides, such as thiosulfates, alkanolamines, and thioethers.

When photosensitive materials are processed with the developers containing compounds having a strong dissolving action for silver halides, such as sulfites and thiosulfates, silver complexes dissolve into the developers in a large amount and are readily reduced to generate silver sludges, which are accumulated in the developers. Especially, when photosensitive materials are processed continuously by automatic processors, the silver sludges not only float in the developer, but also stick to rollers and belts, resulting in stains on the photosensitive materials with the precipitated silver which turn yellow or brown upon reflection of light and which are called silver stains in the form of streaks of rollers.

As inhibitors for formation of silver sludges or contamination of solution, there are known 2-mercapto-1,3,4-thiadiazoles (British Patent No.940,169), 2-mercapto-1,3,4-oxadiazoles or 1-phenyl-5-mercaptotetrazoles (U.S. Pat. No. 3,173,789), D,L-6,8-dithiooctanoic acid (U.S. Pat. No. 3,318,701), o-mercaptobenzoic acid (British Patent No.1, 144,481), aliphatic mercaptocarboxylic acids (U.S. Pat. No.3,628,955), 1-thiazolidine-4-carboxylic acids (J. Photogr. Sci., 13, 233 (1965)), disulfide compounds (Japanese Patent Kokai No.52-36029), 2-benzoxazolethiol and 2-benzimidazolethiol (Photogr. Sci. Eng., 20, 220 (1976)), acetylene glycols (Japanese Patent Kokai No.55-95947), 2-mercaptobenzothiazole-5-sulfonic acid (Japanese Patent Kokai No.56-72441), 2-mercaptobenzimidazole-5-sulfonic acid (Japanese Patent Kokai No.60-258537), etc.

However, when these compounds are used as sludge inhibitors in developers having a dissolving action for silver halides, especially developers containing sulfites in a high concentration (for example, 0.3 mol/l or higher), they suffer from the problems that they lose sludge inhibiting effect due to air oxidation, they must be used in a large amount because of their low sludge inhibiting effect, they have adverse effects on photographic characteristics such as desensitization, decrease in contrast and retardation of development, they are expensive and they are malodorous.

Furthermore, Japanese Patent Kokai No.64-50047 proposes a method for inhibiting formation of silver sludges which comprises allowing a cleaning film characterized by comprising a film support and, provided thereon, a hydrophilic colloid layer containing an organic compound capable of adsorbing silver ion or metallic silver to contact with a developer containing a silver complex dissolved therein due to processing of silver halide photosensitive materials. The feature of the invention is to use an organic compound capable of adsorbing silver ion or metallic silver, and there are problems that synthesis of this organic compound needs many steps or is difficult and the cost for the compound is high.

U.S. Pat. No. 5,210,009 discloses a method for the recovery of silver according to which a sheet having on the surface a hydrophilic colloid layer containing physical development nuclei is rolled with keeping a space and a developer is passed through the space. However, the recovery of silver is low and this method is still unsatisfactory.

Moreover, Japanese Patent Kokai No.3-273235 describes a filter medium containing physical development nuclei and Japanese Patent Kokai No.3-273236 describes a cleaning film or paper having a hydrophilic colloid layer containing physical development nuclei. According to these methods, the developer containing silver ion or silver complex is filtered by the filter medium or is allowed to contact with the cleaning film or paper, thus the silver ion or silver complex in the developer is precipitated as metallic silver on the physical development nuclei by physical development and as a result, concentration of the silver ion or silver complex in the developer decreases thereby inhibiting the formation of silver sludges. These methods are free from the problems such as deterioration in photographic characteristics and increase in cost which are caused by using the aforementioned sludge inhibitors and thus, are effective for inhibition of sludges. However, these methods are unsatisfactory in keeping stably a high physical developability in the filter having physical development nuclei and it is demanded to inhibit formation of silver sludges by more efficiently capturing the silver ions in the developer.

SUMMARY OF THE INVENTION

Accordingly, the first object of the present invention is to improve the method for inhibiting the formation of silver sludges using a filter containing physical development nuclei described in Japanese Patent Kokai No.3-273235, thereby to provide a more efficient method for the inhibition of silver sludges. The second object is to provide a method for processing silver halide photographic photosensitive materials by which a photographic image excellent in finished quality can be obtained, utilizing the above method of silver sludge inhibition.

The above objects of the present invention have been attained by a method which can perform more effectively the method for inhibiting the formation of silver sludges using a filter containing physical development nuclei described in Japanese Patent Kokai No.3-273235, characterized in that a developer is used which contains 20 mol % or more of potassium ion based on the total alkali metal ions, 0.04 mol/l or more of bromine ion or a compound represented by the following formula (I):

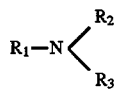

(I)

(wherein $R_1$ represents a hydroxyalkyl group having 2–10 carbon atoms and $R_2$ and $R_3$ each represent a hydrogen atom, an alkyl group having 1–10 carbon atoms or a hydroxyalkyl group having 2–10 carbon atoms) and the developer is filtered by a filter containing physical development nuclei before, during or after processing of the photosensitive material with the developer.

DESCRIPTION OF THE INVENTION

It has been found that when the developer contains potassium ion in an amount of 20 mol % or more based on the total alkali metal ions, silver ion or silver complex dissolved in the developer can be efficiently precipitated as metallic silver on the physical development nuclei in the filter and as a result, the formation of silver sludges can be very effectively inhibited.

The potassium ion can be supplied in any forms or by any methods. For example, the potassium ion may be previously added to the developer in the form of hydroxide, sulfite, carbonate, polycarboxylate or the like. The physical development is accelerated with increase of the content of the potassium ion in the developer and silver sludges are apt to be produced in the case of known developing process. However, when the filter of the present invention is used, the efficiency of capturing silver by the filter increases and it is preferred that the content of potassium ion is 60 mol % or more. However, since potassium ion tends to hinder the photographic fixation, it must be added in such an amount as not adversely affecting the fixation. The content of potassium ion is preferably 80 mol % or less. However, if a measure is taken to prevent the retard of the fixation, for example, in setting of the amount of hardener or silver solvent or the pH value, the pottassium ion can be contained in an amount of more than 80 mol % without any problems.

It has also been found that when the developer contains bromine ion in an amount of 0.04 mol/l or more, silver ion or silver complex dissolved in the developer can be efficiently precipitated as metallic silver on the physical development nuclei in the filter over a long period of time and as a result, the formation of silver sludges can be very effectively inhibited over a long period of time.

The bromine ion can be supplied in any forms or by any methods. For example, the bromine ion may be previously added to the developer in the form of salts with alkali metals such as lithium salts, sodium salts and potassium salts, ammonium salts, salts with amines and the like. Among them, potassium bromide and sodium bromide are especially useful from the point of cost. The efficiency of capturing silver by the filter increases with increase in the content of the bromine ion in the developer. However, as is well known in the art, since bromine ion retards the photographic development, it must be added in such an amount as not adversely affecting the development. The content of bromine ion is preferably 0.2 mol/l or less, more preferably 0.1 mol/l or less. However, if a measure is taken to prevent the retard of the development, for example, addition of sensitizers (such as quaternary ammonium salts) or development accelerators (such as polyethylene glycol), decrease of the amount of inhibitors or setting the pH of the developer at higher than the usual value, the bromine ion can be contained in an amount of more than 0.1 mol/l without any problems.

It has been further found that addition of the compound represented by the above-mentioned formula (I) to the developer is effective for efficiently performing the inhibition of formation of silver sludges using a filter containing physical development nuclei described in Japanese Patent Kokai No.3-273235.

The compound represented by the above formula (I) can efficiently precipitate silver ion or silver complex dissolved in the developer as metallic silver on physical development nuclei in the filter, and as a result, formation of silver sludges can be inhibited. Typical examples of the compound are shown below.

I-(1): N-n-butyldiethanolamine
I-(2): 3-Diethylamino-1,2-propanediol
I-(3): 2-Diethylamino-1-ethanol
I-(4): 2-Diethylamino-1-butanol
I-(5): 3-Dimethylamino-1,2-propanediol
I-(6): 3-Diethylamino-1-propanol
I-(7): 3-Dimethylamino-1-propanol
I-(8): 3-Dipropylamino-1,2-propanediol
I-(9): 2-Dioctylamino-1-ethanol
I-(10): 3-Amino-1,2-propanediol
I-(11): 1-Diethylamino-2-propanol
I-(12): n-Propyldiethanolamine
I-(13): 2-Di-isopropylaminoethanol
I-(14): N,N-di-n-butylethanolamine
I-(15): 3-Di-propylamino-1,2-propanediol
I-(16): 2-Methylamino-1-ethanol
I-(17): 3-Dimethylamino-1,2-propanediol
I-(18): 4-Dimethylamino-1-butanol
I-(19): 1-Dimethylamino-2-butanol
I-(20): 1-Dimethylamino-2-hexanol
I-(21): 5-Dimethylamino-1-pentanol
I-(22): 6-Dimethylamino-1-hexanol
I-(23): 1-Dimethyl-2-octanol
I-(24): 6-Dimethylamino-1,2-hexanediol Addition of the compound in an amount of 0.005–1.0 mol/l exhibits the desired effect. Preferred amount is 0.01–0.2 mol/l.

If the compound of the formula (I) is added in a large amount to the developer or is added to a concentrated developer, sometimes the solubility decreases and the compound is not completely dissolved or even when it is dissolved, it sometimes becomes insoluble with lapse of time during storage. In such case, when compounds having a sulfonic acid group or carboxyl group, such as sodium p-toluenesulfonate, sodium benzenesulfonate, sodium 1-hexanesulfonate, sodium p-toluylate, sodium isobutylate, sodium benzoate, sodium n-caproate, sodium n-caprylate and sodium n-caprate are added as dissolving aids, solubility of the compound increases and the compound can be dissolved in a large amount and furthermore, insolubilization of the compound can be prevented.

In general, an automatic processor is fitted with a filter for removal of dusts or silver sludges in a developer and the developer is filtered always by this filter simultaneously with starting of operation of the automatic processor.

This method for removing silver sludges by filtration with filter can perform removal of silver sludges having a certain size (at least 5–10μ), but it is difficult to remove smaller silver sludges and silver sludges in colloidal state. Furthermore, when the developer contains a large amount of silver sludges, the filter clogs easily and must be changed often.

A method of inhibiting the formation of silver sludges by reducing the concentration of silver ion or silver complex in the developer is most effective. The above-mentioned filter used in the general automatic processors has no effect to reduce the concentration of silver ion or silver complex.

The inventors disclose in Japanese Patent Kokai No.3-273235 that the concentration of silver ion or silver complex in the developer can be reduced by filtering the developer containing silver ion or silver complex by a filter containing physical development nuclei to precipitate metallic silver on the physical development nuclei. Furthermore, it is confirmed that the filter containing physical development nuclei has no difference from general filters in filtering ability and speed.

As the physical development nuclei used in the filters, mention may be made of known physical development nuclei used for diffusion image receiving materials, for example, metals such as gold, silver, platinum, nickel, palladium, cobalt, copper, zinc, cadmium, lead and iron and sulfides of these metals (such as silver sulfide, nickel sulfide, cobalt sulfide, copper sulfide, palladium sulfide, zinc sulfide, cadmium sulfide, lead sulfide and iron sulfide and mixtures thereof) and selenium compounds.

The filters containing physical development nuclei used in the present invention can be produced by immersing a filter in a colloid solution of the metal or sulfide thereof acting as physical development nuclei or allowing the filter to contact with a reaction solution during reaction in preparation of the colloid solution.

As materials of the filters, there may be generally used fibrous cellulose, nitrocellulose, cellulose acetate, polyether sulfone, glass fiber, polypropylene, polyester, polyethylene tetrafluoride resin, cotton, rayon, etc. A wide variety of filters are sold from Toyo Filter Paper Co., Ltd., Cuno Co., Ltd., etc.

The above commercially available filters can be utilized in the present invention.

The filter containing physical development nuclei comprises the above fibers to which physical development nuclei are adsorbed and the adsorbed physical development nuclei are not easily desorbed. Therefore, when the filter containing physical development nuclei contacts with a developer, the physical development nuclei do not dissolve or diffuse into the developer and do not change the photographic characteristics of photosensitive materials processed.

The filters used in the present invention may be in the form of either a cylinder or a sheet.

The filters used in the present invention exhibit the effect when they are immersed in the developer after use for processing silver halide photosensitive materials (namely, the developer containing silver ion or silver complex), but the effect can be increased by passing the developer through the filter, namely, filtering the developer. Therefore, according to a preferable embodiment of the present invention, an automatic processor is equipped with the filter and the developer is filtered with the filter by continuous circulation using a small pump before, during or after the processing of silver halide photosensitive materials. Generation of sludges can be more effectively inhibited by carrying out the filtering of the developer both during and after the processing. The filtration after the processing can be carried out for about 30 minutes to 1 hour and when an automatic processor is used, the developer can be circulated for the given period after the processing. The number of circulations and the flow rate of the developer are not limiting, but with increase in the number of circulation, namely, filtration, the effect is to inhibit the generation of silver sludges increases.

Photographic photosensitive materials to which the present method is applicable are not limiting and can be general photosensitive materials such as room-light photosensitive materials, scanner photosensitive materials, general RAS photosensitive materials and direct positive silver halide photosensitive materials.

The developer used in the present invention may contain usual photographic developing agents such as hydroquinone, alkylhydroquinones (e.g., t-butylhydroquinone, methylhydroquinone and dimethylhydroquinone), catechol, pyrazol, chlorohydroquinone, dichlorohydroquinone, alkoxyhydroquinones (e.g., methoxyhydroquinone or ethoxyhydroquinone), aminophenol developing agents (e.g., N-methyl-p-aminophenol and 2,4-diaminophenol), ascorbic acid developing agents, N-methyl-p-aminophenol sulfate, pyrazolones (e.g., 4-aminopyrazolone), and 3-pyrazolidone developing agents (e.g., 1-phenyl-3-pyrazolidone, 1-phenyl-4,4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone). Especially, combination of hydroquinone with 3-pyrazolidones or hydroquinone with aminophenols is useful for rapid processing at high temperatures. The developer may be activator type developers which contain no developing agents.

The effect to inhibit formation of silver sludges is especially conspicuous when the developer used in the present invention contains a large amount of sulfite ion. As sulfite salts which give sulfite ion, there may be used, for example, sulfite salts with alkali metals such as sodium sulfite, potassium sulfite and potassium metahydrogensulfite. Preferred are potassium salts.

The silver sludges produced in developer are apt to stick to the roller and the belt in processors, and the silver sludges which have stuck to the roller or belt are prone to stain the photosensitive materials. Therefore, the method of the present invention is especially effective in processing by automatic processors.

These automatic processors include, for example, P-710 manufactured by Mitsubishi Paper Mills Ltd., LD281Q, LD360, LD381 and LD480Q manufactured by Dainippon Screen Mfg., Co., Ltd., and FG680A, FG950A and FG710A manufactured by Fuji Photo Film Co., Ltd., and these automatic processors can be equipped with the filter of the present invention.

If necessary, the developer may further contain buffers (e.g., carbonates, boric acid, borates and alkanolamine), alkali agents (e.g., hydroxides and carbonates), dissolving aids (e.g., polyethylene glycols and esters thereof), pH regulators (e.g., organic acids such as acetic acid), sensitizers (e.g., quaternary ammonium salts), development accelerators, surface active agents, hardeners and the like.

The developer may further contain sodium bromide, potassium bromide, sodium chloride, potassium chloride, potassium iodide, ethylene glycol, diethylene glycol, triethylene glycol and the like, and in addition, silver sludge inhibitors such as 2-mercapto-1,3,4-thiadiazoles (British Patent No.940169), 2-mercapto-1,3,4-oxadiazoles or 1-phenyl-5-mercaptotetrazoles (U.S. Pat, No.3,173,789), D,L-6,8-dithiooctanoic acid (U.S. Pat. No. 3,318,701), o-mercaptobenzoic acid (British Patent No.1,144,481), aliphatic mercaptocarboxylic acids (U.S. Pat. No.3,628,955), L-thiazolidine-4-carboxylic acids (J. Photogr. Sci., 13, 233 (1965)), disulfide compounds (Japanese Patent Kokai No.52-36029), 2-benzoxazoiethiol and 2-benzimidazolethiol (Photogr. Sci. Eng., 20, 220 (1976)), acetylene glycols (Japanese Patent Kokai No.55-95947), 2-mercaptobenzothiazole-5-sulfonic acid (Japanese Patent Kokai No.56-72441), sodium 2-mercaptobenzimidazole-5-sulfonate (Japanese Patent Kokai No.56-24347), 5-benzenesulfonamide-2-mercaptobenzimidazole and derivatives thereof (Japanese Patent Kokai Nos.4-282961, 4-189550 and 4-282960) and those which are described in Japanese Patent Kokai Nos.56-24347, 57-99641, 59-79250 and 60-258537.

The developer may further contain antifoggants (e.g. benzotriazoles such as 5-nitroindazole, 5-nitrobenzimidazole, 5-methyl-benzotriazole and 5-nitrobenzotriazole, benzothiazole, tetrazoles such as 1-phenyl-5-mercapto-tetrazole, thiazoles, and compounds described in British Patent No.1,269,268), uneven development inhibitors such as 3-(5-mercaptotetrazole)-benzenesulfonic acid and derivatives thereof described in Japanese Patent Kokai No.62-212651 and chelating agents (e.g., ethylenediaminetetraacetic acid and alkali metal salts thereof, polyphosphates and nitrilo-acetates).

The pH value of the thus prepared developer is selected so as to give the desired density and contrast, and it is preferably in the range of about 8–13.

Alkali agents used for setting pH include pH regulators and buffers such as sodium hydroxide, potassium hydroxide, sodium carbonate, potassium carbonate, trisodium phosphate, tripotassium phosphate, sodium silicate and potassium silicate. As the buffers, there may also be used boron compounds described in Japanese Patent Kokai No.62-186259 and compounds having a dissociation constant of $1\times10^{-11}$–$3\times10^{-13}$ described in Japanese Patent Kokai No.60-93433.

The developing temperature and time are interrelated with each other and are determined in relation with the total treating time and are generally about 20°–50° C., and 10 seconds to 3 minutes. The temperature is preferably about 30°–60° C. for rapid development.

The fixer is an aqueous solution containing a thiosulfate and a water-soluble aluminum compound and desirably has a pH of about 3.8–5.5 (20° C.). In the method of the present invention, a stopping step can be provided after the development, but generally, the stopping step is omitted in a roller feeding type automatic processor. As a result, the developer is carried into the fixer to cause increase of pH value. Therefore, it is preferred to adjust the pH of the fixer to about 3.8–5.0 (20° C.).

The fixing agent is a thiosulfate such as ammonium thiosulfate, sodium thiosulfate, or the like. Especially preferred is ammonium thiosulfate from the point of fixing speed. Amount of the fixing agent can be varied optionally and is usually about 0.1–5 mol/l.

The water-soluble aluminum salt which acts mainly as a hardener in the fixer is a compound generally known as hardener for acidic hardening fixers and examples thereof are aluminum chloride, aluminum sulfate and potash alum.

The fixer may further contain precipitation inhibitors for aluminum such as dibasic acids (e.g., tartaric acid, potassium tartrate, sodium citrate, lithium citrate, and potassium citrate) and preservatives such as sulfites and hydrogensulfites and pH buffers such as acetic acid and boric acid.

Recently, a hydrazine derivative is contained in photographic layers or developers to obtain superhigh contrast characteristics. This means can also be employed in the present invention to exhibit sufficient effect of the present invention.

The hydrazine derivatives used in the present developing method include, for example, hydrazine sulfate, hydrazine hydrochloride and the like and hydrazine derivatives described in U.S. Pat. Nos.4,224,401, 4,243,734, 4,272,614, 4,385,108, 4,269,929 and 4,323,643, Japanese Patent Kokai Nos.56-106244, 61-267759, 61-230145, 62-270953, 62-178246, 62-180361, 62-275247, 63-253357 and 63-265239, and Japanese Patent Application Nos.1-92356, 1-99822, 4-219955 and 4-228752.

The composition of silver halides in the silver halide photographic photosensitive materials includes silver bromide, silver iodobromide, silver iodochloride, silver chlorobromide, silver chloride or the like and the effect of the present invention is not affected by the composition. In general, photographic photosensitive materials which are high in silver chloride content are apt to generate silver sludges since solubility of silver chloride is high. The present invention exhibits conspicuous effect in processing of the photographic photosensitive materials high in silver chloride content. Furthermore, the photosensitive materials may be any of negative type or direct positive type silver halide photographic photosensitive materials and black and white or color silver halide photographic photosensitive materials.

According to the method of the present invention, the photographic materials which have been developed and fixed are washed with water and dried. The washing with water is carried out for nearly completely removing the silver salt dissolved by the fixation and is carried out preferably for 10 seconds to 3 minutes at about 5°–50° C. The drying is carried out at about 30°–80° C. and the drying time can be optionally changed depending on the ambient state and is preferably about 5 seconds to 3.5 minutes.

The following nonlimiting examples illustrate the present invention.

EXAMPLE 1

Filters containing physical development nuclei were prepared in the following manner.

(1) Filter (A) which contained palladium sulfide physical development nuclei:

| | | |
|---|---|---|
| Solution A | 1% Aqueous sodium sulfide solution | 300 ml |
| | Water | 1700 ml |
| Solution B | 0.1% Aqueous palladium chloride solution | 1000 ml |

The solution B at 40° C. was added to the solution A at 40° C. with vigorously stirring, and stirring was continued for 5 minutes to prepare a nuclei solution. A cylindrical cartridge filter (TCW-25-EPS) manufactured by Toyo Filter Paper Co., Ltd. was fitted in a housing (1PC) manufactured by the same company, to which a magnetic pump was connected and the above nuclei solution was circulated for 10 minutes. The filter was taken out and washed with running water for more than 1 hour until sodium sulfide in the running water completely disappeared, followed by drying.

(2) Filter (B) which contained silver sulfide physical development nuclei:

The following solution C was used in place of the solution (B) in the above procedure (1).

| | | |
|---|---|---|
| Solution C | 0.5% Aqueous silver nitrate solution | 300 ml |
| | Water | 700 ml |

The same procedure as above (1) was conducted.

The following developers and fixer were prepared.

| Developer (a): | |
|---|---|
| Disodium ethylenediaminetetraacetate | 2 g |
| Hydroquinone | 24 g |
| 1-Phenyl-3-pyrazolidone | 0.2 g |
| Potassium sulfite | 100 g |
| Potassium bromide | 3.0 g |
| Triethylene glycol | 4.3 g |
| 5-Methylbenzotriazole | 0.05 g |
| Sodium hydroxide | 12 g |
| Potassium hydroxide | 3.0 g |
| Water was added to make up 1 liter in total. | |
| pH 11.5 | |

Developer (b):

This was the same as the developer (a) except containing 80 g of sodium sulfite in place of potassium sulfite.

Developer (c):

This was the same as the developer (b) except for using the sodium hydroxide and the potassium hydroxide in the following amounts, respectively.

| | |
|---|---|
| Sodium hydroxide | 5.6 g |
| Potassium hydroxide | 12 g |

Developer (d):

This was the same as the developer (a) except for replacing the sulfite, sodium hydroxide and potassium hydroxide with the following.

| | |
|---|---|
| Sodium sulfite | 68 g |
| Potassium sulfite | 15 g |
| Sodium hydroxide | 2 g |
| Potassium hydroxide | 20 g |

Developer (e):

This was the same as the developer (d) except for replacing the sulfite with the following.

| | |
|---|---|
| Sodium sulfite | 12 g |
| Potassium sulfite | 85 g |
| Fixer: | |
| Ammonium thiosulfate | 200.0 g |
| Sodium sulfite (anhydrous) | 20.0 g |
| Boric acid | 8.0 g |
| Sodium ethylenediaminetetraacetate | 0.1 g |
| Aluminum sulfate | 15.0 g |
| Sulfuric acid | 2.0 g |
| Glacial acetic acid | 22.0 g |
| Water was added to make up 1 liter in total. | |
| The pH of the fixer was adjusted to 4.2. | |

Amounts of alkali metal ions contained in 1 liter of each of the developer are shown in Table 1.

TABLE 1

| Developer | Potassium ion (a) mol | Sodium ion (b) mol | a/(a + b) × 100 mol % |
|---|---|---|---|
| (a) | 1.342 | 0.311 | 81 |
| (b) | 0.078 | 1.580 | 5 |
| (c) | 0.239 | 1.420 | 14 |
| (d) | 0.429 | 1.230 | 26 |
| (e) | 1.152 | 0.501 | 70 |

The filter (A) containing physical development nuclei was fitted in a housing of four roller-carrying type automatic processors [LD221Q manufactured by Dainippon Screen Mfg. Co., Ltd. which was remodelled so that the developer passed through the filter during operation of the automatic processor by directly connecting the housing (1PC manufactured by Toyo Filter Paper) to the developer circulating system including a circulating pump in a developing tank]. Each of the above developers (a)–(e) and the fixer in an amount of 12 liters were charged in the developing tank.

A roomlight film comprising a polyethylene terephthalate film and a silver chloride emulsion layer (amount of silver: 5 g/m$^2$ and average grain size: 120 mμ) was imagewise exposed and then, this roomlight film of 50 cm×60 cm was processed by the above automatic processor. Developing temperature was 38° C. and developing time was 20 seconds.

One hundred films (per 1 day) of the abovementioned size were processed for 3 days. Occurrence of silver sludges and occurrence of stain on the film were observed. Replenishment of the developer during processing was not carried out.

The same test as above on the filter (A) was conducted by fitting the filter (B) and a comparative filter (C) which contained no physical development nuclei in the developer tank of the above automatic processors.

The state of occurrence of silver sludges is shown in Table 2. In Table 2, the symbols mean the following levels.

⊙: Substantially no sludges occurred in the developing tank and there were no practical problems.

○: Some black precipitates were produced on the bottom of the developing tank, but the film was not stained and there were substantially no practical problems.

Δ: A large amount of black precipitates were produced on the whole bottom of the developing tank and this level was practically unacceptable.

x: In addition to the level shown by Δ, considerable sludges stuck to the roller and this level was utterly unacceptable from a practical standpoint.

TABLE 2

| Filter | Developer | Formation of sludges: The 1st day | The 2nd day | The 3rd day |
|---|---|---|---|---|
| (A) | (a) The present invention | ⊙ | ⊙ | ⊙ |
| | (b) Comparative | ⊙ | x | — |
| | (c) Comparative | ⊙ | ○ | x |
| | (d) The present invention | ⊙ | ⊙ | ○ |
| | (e) The present invention | ⊙ | ⊙ | ⊙ |
| (B) | (a) The present invention | ⊙ | ⊙ | ○ |
| | (b) Comparative | Δ | x | — |
| | (c) Comparative | ○ | x | — |
| | (d) The present invention | ⊙ | ○ | ○ |
| | (e) The present invention | ⊙ | ⊙ | ○ |
| (C) | (a) Comparative | x | — | — |
| | (b) Comparative | Δ | x | — |

TABLE 2-continued

| Filter | Developer | Formation of sludges The 1st day | The 2nd day | The 3rd day |
|---|---|---|---|---|
| | (c) Comparative | Δ | x | — |
| | (d) Comparative | x | — | — |
| | (e) Comparative | x | — | — |

As can be seen from Table 2, formation of silver sludges was quite small when the filters containing physical development nuclei and the developer according to the present invention were used and there were no practical problems. Furthermore, no change in photographic characteristics were recognized in the case of the present invention.

EXAMPLE 2

The same filters (A) and (B) and the same fixer as used in Example 1 were used.

Developers were prepared in the following manner.

| Developer (f): | |
|---|---|
| Disodium ethylenediaminetetraacetate | 2 g |
| Hydroquinone | 24 g |
| 1-Phenyl-3-pyrazolidone | 0.2 g |
| Sodium sulfite | 100 g |
| Triethylene glycol | 4.3 g |
| 5-Methylbenzotriazole | 0.05 g |
| Sodium hydroxide | 14 g |
| Water was added to make up 1 liter in total. | |
| pH: 11.5 | |

Developers (g)–(j) were prepared by adding potassium bromide in an amount of 3 g to 13 g to the above developer (f).

| | | |
|---|---|---|
| Developer (f) Potassium bromide | 0 g | 0.000 mol/l |
| Developer (g) Potassium bromide | 3 g | 0.025 mol/l |
| Developer (h) Potassium bromide | 5 g | 0.042 mol/l |
| Developer (i) Potassium bromide | 8 g | 0.067 mol/l |
| Developer (j) Potassium bromide | 13 g | 0.109 mol/l |

Furthermore, developer (k) was prepared by adjusting the pH of the developer (j) to 12 with sodium hydroxide.

Moreover, developers (l), (m) and (n) were prepared by adding the following compounds of the formula (I) to the developer (f).

| | |
|---|---|
| Developer (l) N,n-butyldiethanolamine | 12 g |
| Developer (m) 3-Dimethylamino-1,2-propanediol | 16 g |
| Developer (n) 6-Dimethylamino-1-hexanol | 6 g |

The filter (A) was fitted in a housing of five roller-carrying type automatic processors [LD221Q manufactured by Dainippon Screen Mfg. Co., Ltd. which was remodelled so that the developer passed through the filter during operation of the automatic processor by directly connecting the housing (1PC manufactured by Toyo Filter Paper Co., Ltd.) to the developer circulating system including a circulating pump in a developing tank]. Each of the above developers (f)–(n) and the fixer in an amount of 12 liters were charged in the developing tank.

A roomlight film comprising a polyethylene terephthalate film and a silver chloride emulsion layer (amount of silver: 5 g/m$^2$ and average grain size: 120 mμ) was imagewise exposed and then, the film of 50 cm×60 cm was processed by the above automatic processors. Developing temperature was 38° C. and developing time was 20 seconds.

One hundred films of the above-mentioned size per one day were processed for 30 days. Occurrence of silver sludges and occurrence of stain on the film were observed. Replenishment of the developer in an amount of 150 cc/m$^2$ was carried out during the processing.

The same test as above on the filter (A) was conducted using the filter (B) and a comparative filter (C) (containing no physical development nuclei) in the developer tank of the above automatic processors.

The state of occurrence of silver sludges was evaluated in the same manner as in Example 1 and is shown in Table 3.

TABLE 3

| Filter | Developer | Formation of sludges The 1st day | The 10th day | The 30th day |
|---|---|---|---|---|
| (A) | (f) Comparative | ◎ | Δ | — |
| | (g) Comparative | ◎ | ○ | Δ |
| | (h) The present invention | ◎ | ◎ | ◎ |
| | (i) The present invention | ◎ | ◎ | ◎ |
| | (j) The present invention | ◎ | ◎ | ◎ |
| | (k) The present invention | ◎ | ◎ | ◎ |
| | (l) The present invention | ◎ | ◎ | ◎ |
| | (m) The present invention | ◎ | ◎ | ◎ |
| | (n) The present invention | ◎ | ◎ | ◎ |
| (B) | (f) Compifative | ◎ | Δ | — |
| | (g) Comparative | ◎ | ○ | Δ |
| | (h) The present invention | ◎ | ◎ | ○ |
| | (i) The present invention | ◎ | ◎ | ◎ |
| | (j) The present invention | ◎ | ◎ | ◎ |
| | (k) The present invention | ◎ | ◎ | ◎ |
| | (l) The present invention | ◎ | ◎ | ◎ |
| | (m) The present invention | ◎ | ◎ | ◎ |
| | (n) The present invention | ◎ | ◎ | ◎ |
| (C) | (f) Comparative | Δ | — | — |
| | (i) Comparative | Δ | — | — |
| | (l) Comparative | Δ | — | — |

As can be seen from Table 3, little silver sludge was formed small when the filters containing physical development nuclei and the developer according to the present invention were used and there were no practical problems.

Relative sensitivity of the developers is shown in Table 4. This is shown by increment or decrement from the sensitivity of the comparative developer (f) on the first day. The sensitivity is expressed by 10 ×log E where E is an exposure.

TABLE 4

| Filter | Developer | Change in sensitivity The 1st day | The 10th day | The 30th day |
|---|---|---|---|---|
| (A) | (f) Comparative | 0.0 | 0.1 | — |
| | (g) Comparative | 0.0 | 0.1 | 0.1 |
| | (h) The present invention | −0.2 | −0.1 | −0.1 |
| | (i) The present invention | −0.3 | −0.3 | −0.3 |
| | (j) The present invention | −0.5 | −0.4 | −0.5 |
| | (k) The present invention | 0.1 | 0.0 | 0.1 |
| | (l) The present invention | 0.2 | 0.2 | 0.2 |
| | (m) The present invention | 0.3 | 0.2 | 0.3 |

TABLE 4-continued

| Filter | Developer | Change in sensitivity The 1st day | The 10th day | The 30th day |
|---|---|---|---|---|
| | (n) The present invention | 0.2 | 0.1 | 0.2 |
| (B) | (f) Comparative | 0.0 | −0.1 | — |
| | (g) Comparative | −0.1 | 0.0 | −0.1 |
| | (h) The present invention | −0.1 | −0.1 | −0.1 |
| | (i) The present invention | −0.3 | −0.3 | −0.3 |
| | (j) The present invention | −0.4 | −0.5 | −0.5 |
| | (k) The present invention | 0.1 | 0.1 | 0.1 |
| | (l) The present invention | 0.2 | 0.1 | 0.2 |
| | (m) The present invention | 0.3 | 0.3 | 0.3 |
| | (n) The present invention | 0.2 | 0.1 | 0.2 |
| (C) | (f) Comparative | 0.0 | — | — |
| | (i) Comparative | −0.3 | — | — |
| | (l) Comparative | 0.2 | — | — |

As can be seen from Table 4, when the developer of the present invention was used, influence on photographic characteristics was quite little and there was no problem.

EXAMPLE 3

Filters containing physical development nuclei were prepared in the following manner.

(1) A filter containing palladium sulfide physical development nuclei:

| | | |
|---|---|---|
| Solution A | 1% Aqueous sodium sulfide solution | 1200 ml |
| | Water | 4000 ml |
| Solution B | 1% Aqueous palladium chloride solution | 890 ml |
| | Water | 4000 ml |

The solution B at 40° C. was added to the solution A at 40° C. with vigorous stirring, and the mixture was kept at 40° C. for 5 minutes. Then, the resulting solution was filtered by a filter (capsule filter HDCDFA201H200 manufactured by Pall Co., Ltd.) using a small pump to allow the palladium sulfide physical development nuclei to be contained in the filter. Furthermore, the filter was washed with running water for more than 1 hour until sodium sulfide in the running water completely disappeared, followed by drying.

(2) A filter containing silver sulfide physical development nuclei:

This was prepared in the same manner as in the above (1) except that the following solution was used in place of the solution B.

| | |
|---|---|
| 5% Aqueous silver nitrate solution | 850 ml |
| Water | 4000 ml |

(3) A filter containing nickel sulfide physical development nuclei:

This was prepared in the same manner as in the above (1) except that the following solution was used in place of the solution B.

| | |
|---|---|
| 5% Aqueous nickel nitrate solution | 730 ml |
| Water | 4000 ml |

The procedure was utterly the same as in (1).

Developers and a fixer were prepared as shown in Tables 5 and 6.

TABLE 5

| Developer (g) | (The present invention) A | B | C |
|---|---|---|---|
| N-methyl-p-aminophenol ½$H_2SO_4$ | 0.3 | 0.3 | 0.3 |
| Potassium sulfite | 80 | 80 | 80 |
| Sodium hydroxide | 22 | 22 | 22 |
| Hydroquinone | 50 | 50 | 50 |
| Sodium ethylenediamine-diacetate | 1.0 | 1.0 | 1.0 |
| Potassium hydroquinonemono-sulfonate | 40 | 40 | 40 |
| Sodium metaborate tetra-hydrate | 40 | 40 | 40 |
| 5-Methylbenzotriazole | 0.35 | 0.35 | 0.35 |
| Sodium 3-(5-mercaptotetra-zole)benzenesulfoate | 0.25 | 0.25 | 0.25 |
| Potassium bromide | 8 | 8 | 8 |
| p-Toluenesulfonic acid | 8 | 8 | 8 |
| Potassium hydroxide | 27 | 27 | 27 |
| N-p-butyldiethanolamine | 12 | — | — |
| 3-Dimethylamino-1,2-propanediol | — | 16 | — |
| 6-Dimethylamino-1-hexanol | — | — | 6 |
| Water was added to make up 1 liter in total. pH was adjusted to 11.80–12.00 with sodium hydroxide. | | | |

TABLE 6

| Fixer (g) | |
|---|---|
| Ammonium thiosulfate | 125 |
| Sodium sulfite (anhydrous) | 22 |
| Sodium metaborate (tetrahydrate) | 15 |
| Acetic acid | 22 |
| Sodium acetate | 11 |
| Sodium tartrate (dihydrate) | 5 |
| Aluminum sulfate | 10 |
| Water was added to make up 1 liter in total. The pH was adjusted to 5.00 with sulfuric acid. | |

The above filters (1), (2) and (3) were fitted in automatic processors (LD221Q manufactured by Dainippon Screen Mfg. Co., Ltd.). (Since LD221 is a kind of processor which is not fitted with a filter, this was remodelled so that the developer passed through the filter during operation of the automatic processor by directly connecting the housing of the filter to a circulating pump of the developing tank). Each of the developers (A), (B) and (C) of the present invention was charged in the automatic processor as shown in Table 7 and the above fixer was used in all of the automatic processors. (The volume of the developer and the fixer was 12 liters.)

The test on occurrence of silver sludges was conducted in the following manner.

A roomlight film comprising a polyethylene terephthalate film and a pure silver chloride emulsion layer (amount of silver: 5 g/$m^2$ and average grain size: 120 mμ) was imagewise exposed and then, was processed by the above automatic processors. Developing temperature was 38° C. and developing time was 20 seconds.

The film to be processed had a size of large whole sheet (20 inches×24 inches) and the proportion of black and white of the imagewise exposure was 50%. Two hundred films of the above size were processed by the automatic processors. Amounts of silver dissolved into the developer after processing of 50th film and 200th film were measured by atomic absorption spectrometry. Furthermore, after processing of the two hundred films, the automatic processor was stopped and left to stand for 2 days. Then, stain of the developing tank and roller and stain of the photosensitive materials were visually observed. The stain of the photosensitive materials was determined by reoperating the automatic processor after leaving for 2 days and processing five films and observing the stain of the films. Replenishment of the developer during processing was not carried out. The results are shown in Table 7.

TABLE 7

| Filter | | (1) | (1) | (1) | (2) | (3) |
|---|---|---|---|---|---|---|
| Developer | | A The present invention | B The present invention | C The present invention | A The present invention | A The present invention |
| Amount of dissolved silver: ppm | Processing of 50 films | 1.0 | 0.9 | 1.2 | 1.3 | 0.8 |
| | Processing of 100 films | 1.4 | 1.0 | 1.5 | 1.5 | 1.2 |
| Formation of sludges | Developing tank. Roll | Neither developing tank nor roll were stained | Neither developing tank nor roll were stained | Neither developing tank nor roll were stained | Neither developing tank nor roll were stained | Neither developing tank nor roll were stained |
| | Film | No stain | No stain | No stain | No stain | No stain |

As can be seen from Tables 7, conspicuous effects were also exhibited in the case of developers comprising the combination of the requirements of the present invention, namely, containing potassium ion in an amount of 20 mol % or more based on the total alkali metal ions, containing 0.04 mol/l or more of bromide ion and containing the compound of the formula (I).

What is claimed is:

1. A method for developing an exposed black and white silver halide photographic photosensitive material with a developer containing a sulfite wherein said developer contains 0.04 mol/l or more of bromine ion or a compound represented by the following formula (I):

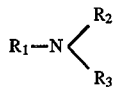

(I)

wherein $R_1$ represents a hydroxyalkyl group having 2–10 carbon atoms and $R_2$ and $R_3$ each represent a hydrogen atom, an alkyl group having 1–10 carbon atoms or a hydroxyalkyl group having 2–10 carbon atoms and the developer is filtered by a filter containing physical development nuclei before, during or after development of the photosensitive material with the developer.

2. A method according to claim 1 which uses an automatic processor.

3. A method according to claim 1, wherein the amount of the compound represented by the formula (I) is 0.005–1.0 mol/l.

4. A method according to claim 1, wherein the filter is in the form of a cylinder or a sheet.

5. A method according to claim 1, wherein the developer further contains potassium ion in an amount of 20 mol % or more based on the total alkali metal ion.

6. A method according to claim 1, wherein the developer contains bromine ion in an amount of 0.04 mol/l or more and the compound represented by the formula (I).

7. A method according to claim 6, wherein the developer further contains potassium ion in an amount of 20 mol % or more based on the total alkali metal ion.

* * * * *